US009423089B2

(12) United States Patent
Lee

(10) Patent No.: US 9,423,089 B2
(45) Date of Patent: Aug. 23, 2016

(54) HEAD LAMP FOR VEHICLE

(71) Applicant: Hyundai Motor Company, Seoul (KR)
(72) Inventor: Seonghoon Lee, Hwaseong-si (KR)
(73) Assignee: Hyundai Motor Company, Seoul (KR)

( * ) Notice: Subject to any disclaimer, the term of this patent is extended or adjusted under 35 U.S.C. 154(b) by 58 days.
(21) Appl. No.: 14/488,942
(22) Filed: Sep. 17, 2014
(65) Prior Publication Data
US 2015/0085515 A1 Mar. 26, 2015
(30) Foreign Application Priority Data
Sep. 25, 2013 (KR) ..... 10-2013-0114058
(51) Int. Cl.
*F21S 8/10* (2006.01)
(52) U.S. Cl.
CPC ..... *F21S 48/145* (2013.01); *F21S 48/1216* (2013.01); *F21S 48/1225* (2013.01); *F21S 48/1258* (2013.01); *F21S 48/1305* (2013.01); *F21S 48/1388* (2013.01); *F21S 48/142* (2013.01); *F21S 48/15* (2013.01)
(58) Field of Classification Search
CPC . F21S 48/145; F21S 48/1216; F21S 48/1305; F21S 48/142; F21S 48/1225; F21S 48/1258; F21S 48/1388; F21S 48/15
USPC ..... 362/507, 538, 539, 520, 521
See application file for complete search history.

(56) References Cited

U.S. PATENT DOCUMENTS 1,671,671 A * 5/1928 Silas Cordes ..... B60Q 1/24 362/291
4,622,626 A * 11/1986 Sassmannshausen F21S 48/2212 362/305
4,912,606 A * 3/1990 Yamamoto ..... B60Q 1/2607 362/309
7,364,332 B2 * 4/2008 Komatsu ..... F21S 48/1186 362/509
8,939,621 B2 * 1/2015 Brown ..... F21S 48/1241 362/507
2011/0002135 A1 * 1/2011 Hara ..... F21V 5/008 362/516
2011/0199777 A1 * 8/2011 Naganawa ..... F21S 48/1159 362/539
2012/0014125 A1 * 1/2012 Uchida ..... F21S 48/1382 362/538
2012/0051078 A1 * 3/2012 Kinoshita ..... F21S 48/1382 362/538

FOREIGN PATENT DOCUMENTS

JP 2005-322460 A 11/2005
JP 2010-218889 A 9/2010
JP 2012-99419 A 5/2012
KR 10-1232305 B1 2/2013

* cited by examiner

*Primary Examiner* — Laura Tso
(74) *Attorney, Agent, or Firm* — Morgan, Lewis & Bockius LLP

(57) ABSTRACT

A head lamp for a vehicle may include a light source emitting a light, a reflective mirror reflecting the light emitted from the light source, a shield implementing a low beam by transmitting a part of the light that is emitted from the light source and/or reflected by the reflective mirror and projected toward a front of the vehicle and shielding other part of the light that is emitted from the light source and/or reflected by the reflective mirror and projected toward the front of the vehicle, a main hole formed at the shield to allow the part of the light pass through, a main lens transmitting the part of the light that has passed through the main hole of the shield toward the front of the vehicle, a reflective surface reflecting the other part of the light, and a sub lens transmitting the light reflected by the reflective surface.

10 Claims, 8 Drawing Sheets

FIG. 7

| Category | Figure (existing) | Figure (improving) |
|---|---|---|
| Lens transmissivity | 88% | 88% |
| Main lens transmissivity | 85% | – |
| Shield efficiency | 60% | 40% |
| Reflective mirror reflectivity | 85% | 85% |
| Shield reflective surface reflectivity | – | 90% |
| Reflective mirror effective solid angle | 9.93 | 9.93 |
| Light source effective solid angle | 10.254 | 10.254 |

< Table 1 >

HEAD LAMP FOR VEHICLE

CROSS-REFERENCE TO RELATED APPLICATION

The present application claims priority of Korean Patent Application Number 10-2013-0114058 filed on Sep. 25, 2013, the entire contents of which application are incorporated herein for all purposes by this reference.

BACKGROUND OF INVENTION

1. Field of Invention

The present invention relates to a head lamp for a vehicle. More particularly, the present invention relates to a head lamp for a vehicle, of which luminous efficiency is improved.

2. Description of Related Art

Generally, the head lamp in the vehicle is also called as a head light or a head lamp which is a lamp to light a front direction for safe running of the vehicle at night or in a dark space. Though it was circular mostly before, currently a lamp having a unique shape and structure is increasingly matched with a design of a vehicle body.

The head lamp in a vehicle is made to have a light beam therefrom to be shifted in up/down directions for preventing a driver of an opposite vehicle from being dazzled by the light beam emitted from the head lamp. According to a safety standard, it is a regulation that a high beam is required to identify an obstacle existing at 100*m* ahead of the vehicle and a low beam is required to identify an obstacle existing at 40*m* ahead of the vehicle.

In order to implement such a high beam and a low beam, there is a shield interposed between a light source and a lens. The shield is made to shield a portion of the light incident on the lens from the light source or a reflective mirror. And, according to a shape and movement of the shield, the high beam or the low beam is implemented, selectively.

However, since the light shielded by the shield is failed to be used as an effective light of the head lamp, there may be a limit of head lamp efficiency. In addition, if the luminance efficiency of the light passing through the shield is too low, the head lamp efficiency may become poor in comparison to a performance of the light source. Particularly, in case that a low beam is implemented, amount of the effective light of a head lamp may be deteriorated as amount of the light shielded by the shield is increased.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

The present invention has been made in an effort to provide a head lamp for a vehicle having advantages of improving luminous efficiency. In addition, the present invention has been made in an effort to a head lamp for a vehicle having further advantages of improving a performance of low beam by a simple configuration without increasing the production cost.

A head lamp for a vehicle according to various aspects of the present invention may include: a light source emitting a light; a reflective mirror reflecting the light emitted from the light source; a shield implementing a low beam by transmitting a part of the light that is emitted from the light source and/or reflected by the reflective mirror and projected toward a front of the vehicle and shielding other part of the light that is emitted from the light source and/or reflected by the reflective mirror and projected toward the front of the vehicle; a main hole formed at the shield to allow the part of the light pass through; a main lens transmitting the part of the light that has passed through the main hole of the shield toward the front of the vehicle; a reflective surface reflecting the other part of the light; and a sub lens transmitting the light reflected by the reflective surface.

The reflective surface may be integrally formed with the shield, and the head lamp may further include a sub hole which is formed at the shield to allow the light reflected by the reflective surface pass through.

The sub lens may transmit the light the light that has passed through the sub hole of the shield. The sub lens may transmit the light that has passed through the sub hole of the shield to an area that is not illuminated by the part of the light that has passed through the main hole of the shield and transmitted by the main lens. The light passed through the sub hole of the shield and transmitted by the sub lens may enlarge an area of the low beam The head lamp may further include a holder disposed between the main lens and the shield such that the main lens is disposed apart from the shield by a set distance, wherein the holder connects the main lens with the shield, and comprises a groove formed at the holder for disposing the reflective surface and corresponding to the sub hole.

The light source may be mounted to the reflective mirror, and the shield may be interposed between the reflective mirror and the holder, and the head lamp may further include a bezel formed in a hollow cylinder shape for disposing inside thereof an assembly that includes the reflective mirror, the shield, the holder and the main lens. The bezel may include a main lens hole for disposing the main lens such that the light passed the main lens is directed toward the front of the vehicle, and a sub lens hole for mounting the sub lens such that the light passed the sub lens is directed toward the front of the vehicle.

The light reflected by the reflective surface may be directed to implement the low beam. The light reflected by the reflective surface may be directed to an area that is not illuminated by the light passed through the main hole of the shield and transmitted by the main lens. The light reflected by the reflective surface and implementing the low beam may improve utilization efficiency of the light emitted from the light source.

The methods and apparatuses of the present invention have other features and advantages which will be apparent from or are set forth in more detail in the accompanying drawings, which are incorporated herein, and the following Detailed Description, which together serve to explain certain principles of the present invention.

BRIEF DESCRIPTION OF THE DRAWINGS

FIG. 7 is a table showing efficiency of an exemplary head lamp for a vehicle according to the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
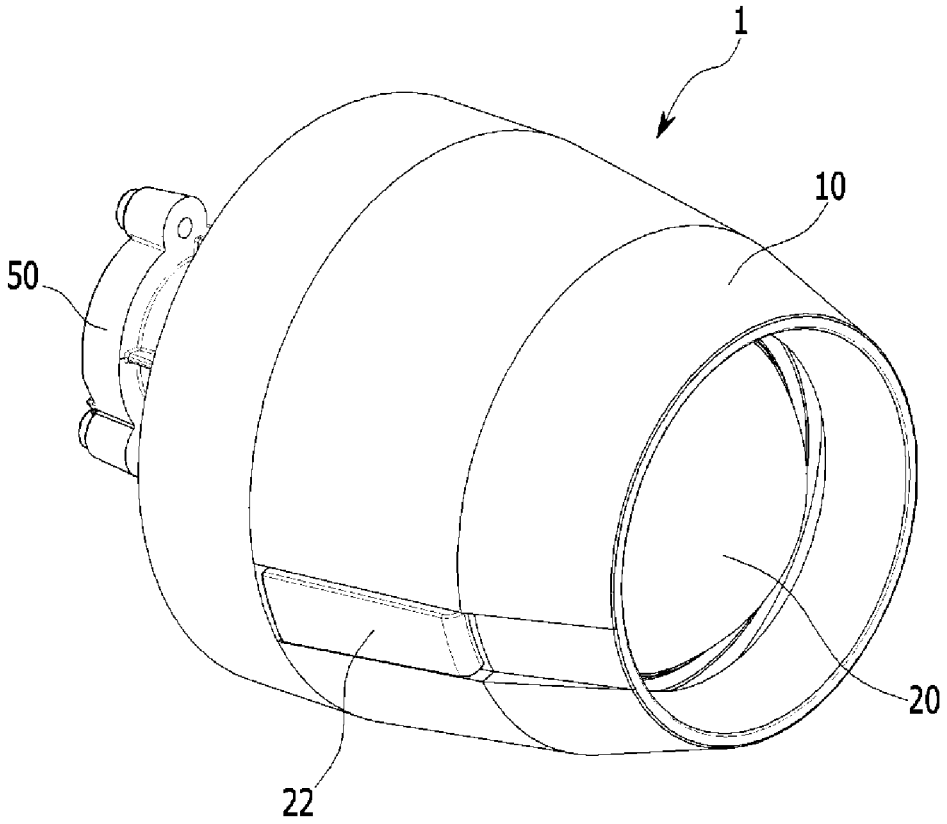
FIG. 1 is a front perspective view of an exemplary head lamp for a vehicle according to the present invention.
Figure 2:
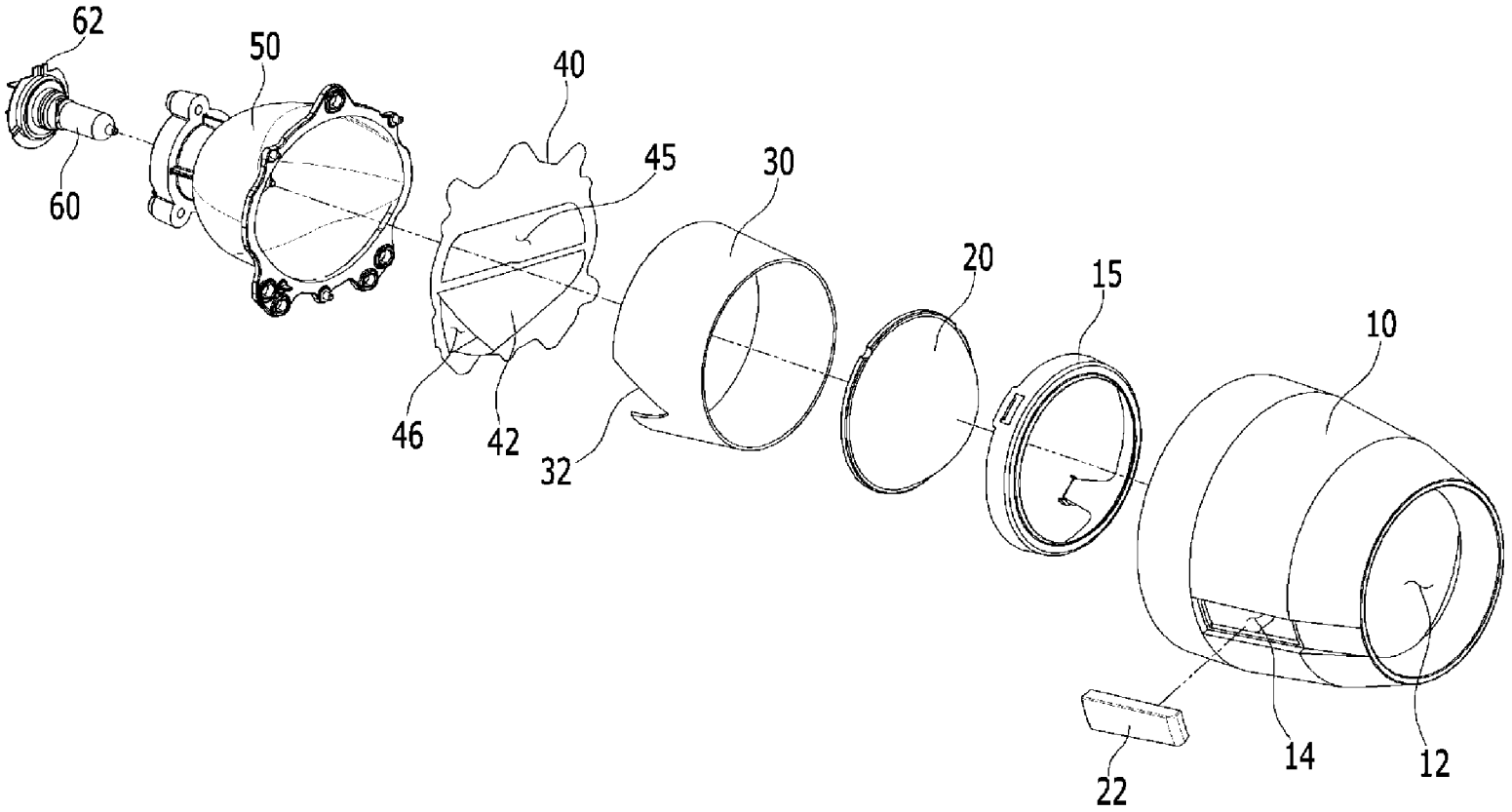
FIG. 2 is an exploded view of an exemplary head lamp for a vehicle according to the present invention.

FIG. 1 is a front perspective view of a head lamp for a vehicle, and FIG. 2 is an exploded view of a head lamp for a vehicle according to various embodiments of the present invention. As shown in FIG. 1 and FIG. 2, a head lamp 1 for a vehicle according to various embodiments of the present invention includes a bezel 10, a main lens 20, a sub lens 22, a holder 30, a shield 40, a reflective mirror 50, and a light source 60.

The bezel 10 is formed in a hollow cylinder shape that both surfaces thereof are open. In addition, the bezel 10 is a housing of the assembly in which the main lens 20, the sub lens 22, the holder 30, the shield 40, and the reflective mirror 50 are assembled, and the assembly of the main lens 20, the sub lens 22, the holder 30, the shield 40, and the reflective mirror 50 is inserted along a length direction of the bezel 10.

The main lens 20 is disposed so as to collect the light emitted from the light source 60 and direct the collected light toward a forward direction of the head lamp 1. In addition, in order to achieve a required aberration correction state with a small number of faces, the main lens 20 may be an aspherical lens.

The sub lens 22 is disposed so as to collect the light emitted from the light source 60 and direct the collected light toward a predetermined direction in directions that a forward direction of the head lamp 1 is excepted.

The holder 30 is formed in a ring shape that both surfaces thereof are open and is coupled with the main lens 20. In addition, the holder 30 and the main lens 20 are coupled with each other as a lens sitting ring 15 formed in a ring shape is coupled with the holder 30 so as to surround lens in the state that the main lens 20 is contacted with one open surface of the holder 30.

The shield 40 is interposed between the light source 60 and the main lens 20 so as to implement low beam of the head lamp 1. In addition, the shield 40 is formed to shield a part of the light transmitted toward the main lens 20 from the light source 60 and the reflective mirror 50. Further, the shield 40 is formed to transmit the shielding light to the sub lens 22. Meanwhile, the shield 40 is coupled with the other opened surface of the holder 30.

The reflective mirror 50 is coupled with the other opened surface of the holder 30. That is, the shield 40 is interposed between the other surface of the holder 30 and the reflective mirror 50. Meanwhile, the shield 40 may be formed in a thin plate shape. That is, the holder 30 is disposed so as to position the main lens 20 apart from the shield 40 by a width of the holder 30.

In addition, the reflective mirror 50 is adapted to be coupled to the light source 60. Further, the reflective mirror 50 is disposed so as to reflect the light emitted from the light source 60 toward the forward direction of the head lamp 1.

The bezel 10 includes a main lens hole 12 and a sub lens hole 14. The main lens hole 12 and the sub lens hole 14 are formed by penetrating the bezel 10 so as to communicate an outside of the bezel with inside of the bezel 10.

The main lens hole 12 is a hole which is formed such that the light passing the main lens 20 is directed toward the forward direction of the head lamp 1. In addition, the main lens hole 12 may be one of the two opened surfaces of the bezel 10. Meanwhile, the assembly that includes the main lens 20, the sub lens 22, the holder 30, the shield 40 and the reflective mirror 50 may be inserted through the other opened surfaces of the bezel 10.

The sub lens hole 14 is a hole which is formed such that the sub lens 22 is mounted to the bezel 10. That is, the sub lens hole 14 is formed in a shape to correspond with the sub lens 22.

The shield 40 includes a main hole 45, a reflective surface 42, and a sub hole 46. The main hole 45 is a hole which is formed for passing the light emitted from the light source 60 and/or reflected by the reflective mirror 50 toward the main lens 20. In addition, the light transmitted to the surface of the shield 40 escaping from the main hole 45 is shielded so as not to be transmitted toward the main lens 20.

The reflective surface 42 is formed so as to transmit to the sub lens 22 the light that are shielded and not to be transmitted toward the main lens 20. In addition, the reflective surface 42 is formed to effectively reflect the light.

The sub hole 46 is a hole which is formed such that the light reflected by the reflective surface 42 passes the shield 40 toward the sub lens 22. Meanwhile, a groove 32 is formed at the holder 30 for disposing the reflective surface 42 and the sub hole 46 such that the light reflected by the reflective surface 42 is transmitted to the sub lens 22 through the sub hole 46.

The light source 60 includes a power supply 62. The power supply 62 functions to receive electric energy and convert the electric energy received thus to light energy.

Figure 3:
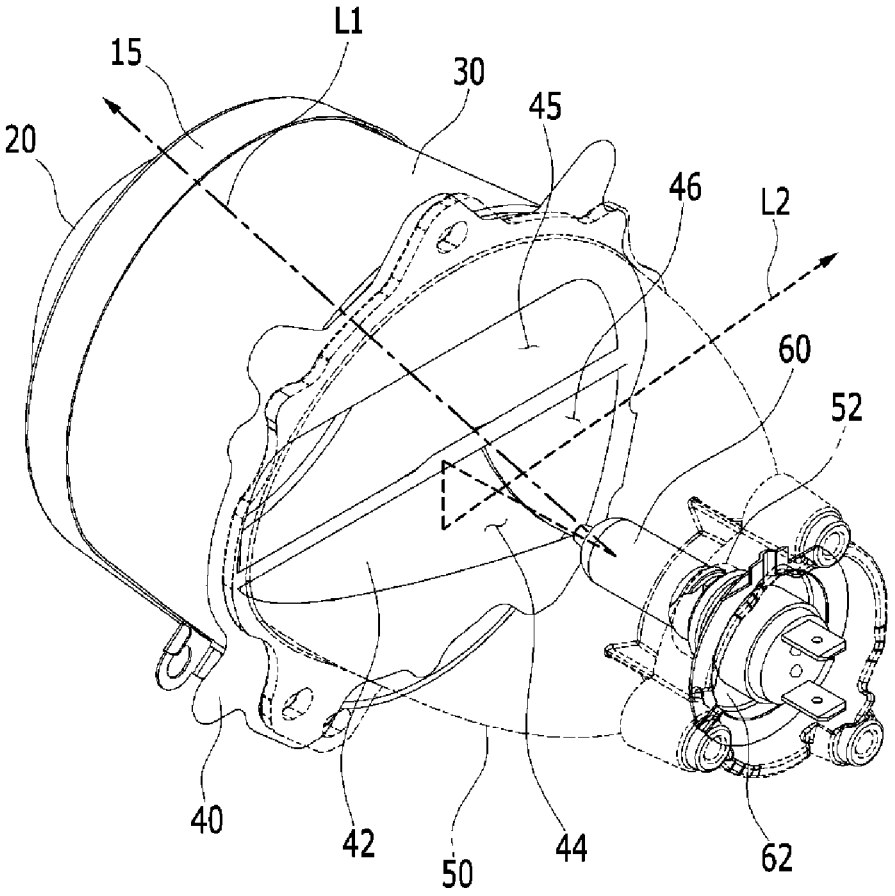
FIG. 3 is a rear perspective view of an exemplary head lamp for a vehicle according to the present invention.
Figure 4:
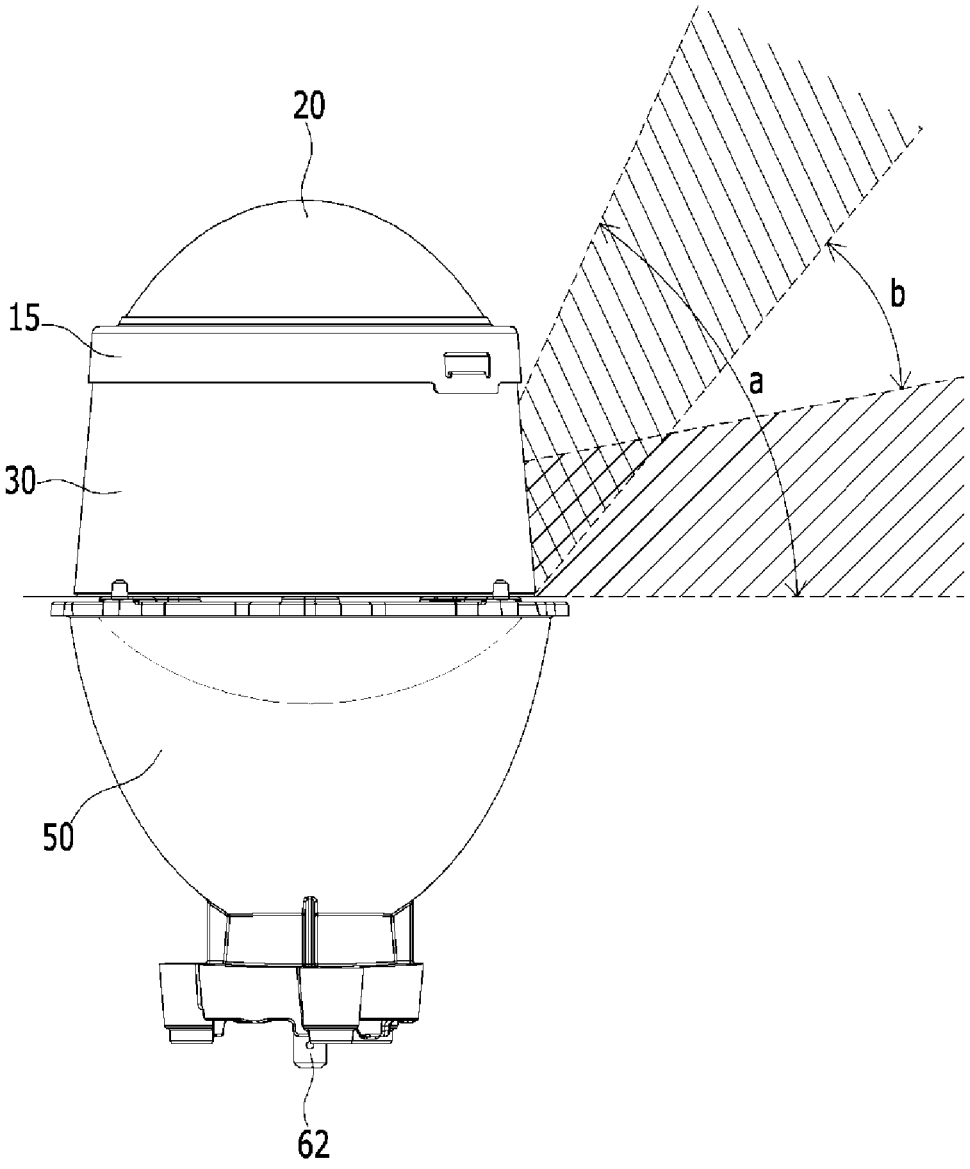
FIG. 4 is a top plan view of an exemplary head lamp for a vehicle according to the present invention.
Figure 5:
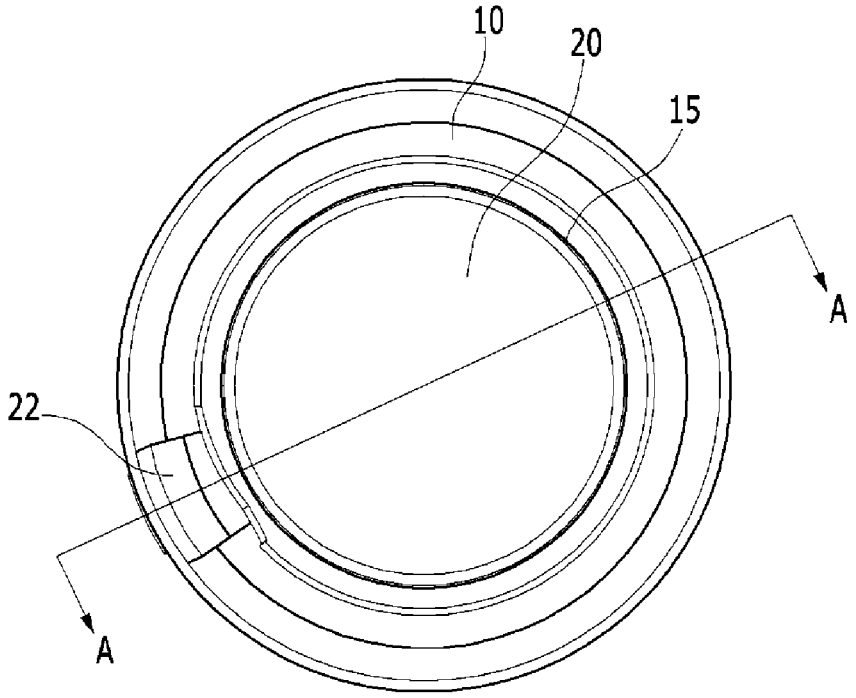
FIG. 5 is a front view of an exemplary head lamp for a vehicle according to the present invention.
Figure 6:
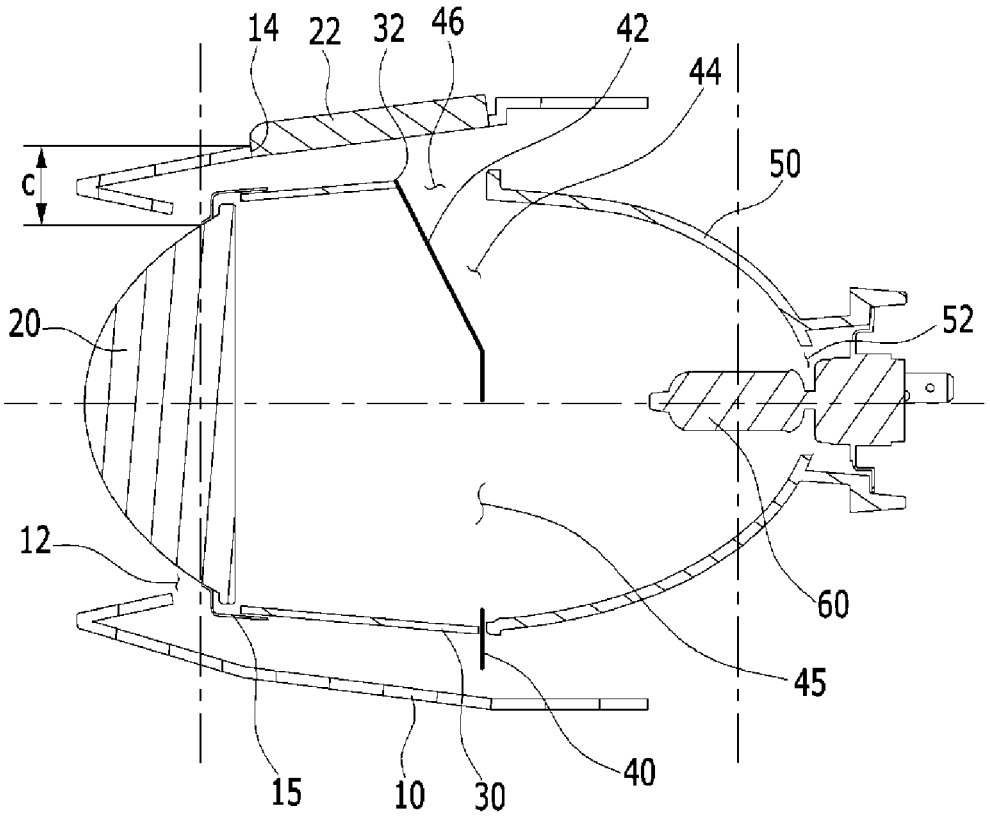
FIG. 6 is a cross-sectional view taken along line A-A of FIG. 5.

FIG. 3 is a rear perspective view of a head lamp for a vehicle, FIG. 4 is a top plan view of a head lamp for a vehicle, and FIG. 5 is a front view of a head lamp for a vehicle according to various embodiments of the present invention. FIG. 6 is a cross-sectional view taken along line A-A of FIG. 5.

FIG. 3 and FIG. 4, in which the bezel 10 is removed, illustrate the assembly including the main lens 20, the sub lens 22, the holder 30, the shield 40, the reflective mirror 50 and the light source 60. In addition, the reflective mirror 50 is diaphanously represented in FIG. 3 so as to show the internal configuration of the reflective mirror 50 in a backward direction of the head lamp 1. As shown in FIG. 3, the reflective mirror 50 includes a light source mounting hole 52, and the shield 40 further includes a reflective surface hole 44.

The light source mounting hole 52 is a hole which is formed for mounting the light source 60. In addition, a portion of the light source 60 is inserted through the light source mounting hole 52 to the inside of the reflective mirror 50, and the power supply 62 of the light source 60 is disposed at the outside of the reflective mirror 50. The power supply 62 is connected with a battery by a cable so as to receive power from the battery.

The reflective surface hole 44 is a hole which is formed such that the light emitted from the light source 60 which is inserted to inside the reflective mirror 50 or the light reflected by the reflective mirror 50 passes the shield 40 formed in the thin plate shape in the portion escaping from the main hole 45 so as to be transmitted to the reflective surface 42. That is, a part of the light emitted from the light source 60 or the reflective mirror 50 passes the reflective surface hole 44 so as to be reflected by the reflective surface 42 and passes the sub hole 46 so as to be transmitted to the sub lens 22 (referring to FIG. 6).

FIG. 3 shows a path L2 of the light which is transmitted from the light source 60 to the sub lens 22 with a dotted arrow line. Meanwhile, a path L1 of the light which is emitted from the light source 60 and reflected by the reflective mirror 50 to the main lens 20 through the main hole 45 of the shield 40 is illustrated with a short dash arrow line.

Herein, a shape of the reflective surface 42 may be readily adjusted to effectively reflect the light to the sub lens 22. In addition, shapes of the reflective surface hole 44 and the sub hole 46 may be formed according to the shape of the reflective surface 42.

FIG. 4 shows a direction and/or an illuminated area where the light passing the sub hole 46 is developed. In FIG. 4, angle "a" represents an area where the light passing the sub hole 46 projects or illuminates, and angle "b" represents an un-illuminated area according to the shape of the reflective surface 42 of the shield 40. Accordingly, angle "a-b", indicated by the hatching inside of the dotted lines, represents an illuminated area. In various embodiments, the angle b is reduced to zero or disappeared as the light passing the sub hole 46 passes the sub lens 22, and consequently, illuminating range is ensured by the angle a (referring to FIG. 6).

As shown in FIG. 5, the sub lens 22 disposed so as to direct the light passing the sub lens 22 toward a lower side direction. Therefore, efficiency of low beam can be improved.

As shown in FIG. 6, the main lens 20 and the sub lens 22 are disposed away from each other, and have a distance "c" between the main lens 20 and the sub lens 22. Herein, the main lens 20 and the sub lens 22 are disposed such that the distance "c" is shorter than 15 mm. This satisfies regulations on the single lamp. In addition, it is possible that the distance "c" is formed to be shorter than 15 mm as the sub lens 22 is disposed at the bezel 10.

FIG. 7 is a table showing efficiency of a head lamp for a vehicle according to various embodiments of the present invention. In FIG. 7, the existing figure lists characteristics with respect to the light passing the main lens 20.

The lens transmissivity of the existing figure is a transmissivity of a front lens which is disposed front of the main lens 20 and covers the head lamp 1. In addition, the lens transmissivity of the existing figure is exemplified by 88%.

The main lens transmissivity of the existing figure is a transmissivity of the main lens 20. In addition, the main lens transmissivity of the existing figure is exemplified by 85%.

The shield efficiency of the existing figure is a ratio associated with the light emitted from the light source 60 and/or reflected by the reflective mirror 50 toward the main lens 20 that passes the main hole 45 of the shield 40. As described above, a part of the light emitted from the light source 60 and/or reflected by the reflective mirror 50 toward the main lens 20 is shielded by the shield 40. In addition, the shield efficiency of the existing figure is exemplified by 60%.

The reflective mirror reflectivity of the existing figure is an efficiency of the reflective mirror 50 that reflects the light emitted from the light source 60 and transmitted to the reflective mirror 50. In addition, the reflective mirror reflectivity of the existing figure is exemplified by 85%.

In FIG. 7, the improving figure lists characteristics with respect to the light passing the sub lens 22.

The lens transmissivity of the improving figure is a transmissivity of the sub lens 22. In addition, the lens transmissivity of the improving figure is exemplified by 88%.

The shield efficiency of the improving figure is a ratio associated with the light emitted from the light source 60 and/or reflected by the reflective mirror 50 toward the main lens 20 that passes the reflective surface hole 44 of the shield 40. As described above, a part of the light emitted from the light source 60 and reflected by the reflective mirror 50 toward the main lens 20 is shielded by the shield 40. Meanwhile, the light shielded by the shield 40 and not transmitted to the main lens 20 passes the reflective surface hole 44, is reflected by the reflective surface 42, passes the sub hole 46 and then is transmitted to the sub lens 22. In addition, the shield efficiency of improving figure is exemplified by 40%.

The reflective mirror reflectivity of the improving figure is an efficiency of the reflective mirror 50 that reflects the light emitted from the light source 60 and transmitted to the reflective mirror 50. That is, the reflective mirror reflectivity of the improving figure is the reflectivity of the reflective mirror 50, and thus is equal to the reflective mirror reflectivity of the existing figure, and is exemplified by 85%.

The shield reflective surface reflectivity of the improving figure is an efficiency representing the percentage of the light transmitted to the reflective surface 42 of the shield 40 that is reflected. In addition, the shield reflective surface reflectivity of the improving figure is exemplified by 90%.

Meanwhile, the effective solid angle of the light source 60 and the effective solid angle of the reflective mirror 50 are respectively exemplified by 10.254 sr and 9.93 sr.

The optical system efficiency according to the existing figure is obtained by multiplying the lens transmissivity, the main lens transmissivity, the shield efficiency, the reflective mirror reflectivity, and average lumen utilization factor of the existing figure together. In addition, the optical system efficiency according to the improving figure is obtained by multiplying the lens transmissivity, the shield efficiency, the reflective mirror reflectivity, the shield reflective surface reflectivity, and average lumen utilization factor of the improving figure together. Herein, the average lumen utilization is the effective solid angle of the reflective mirror 50/the effective solid angle of the light source 60. The calculation of the optical system efficiency is known such that a detailed description thereof will be omitted.

In accordance with the calculation, the optical system efficiency of the existing figure is to be:

$$0.88\times0.85\times0.6\times0.85\times(9.93/10.254)=0.369\%$$

and the optical system efficiency of the improving figure is to be:

$$0.88\times0.4\times0.85\times0.9\times(9.93/10.254)=0.261\%$$

Therefore, the optical system efficiency of a head lamp 1 for a vehicle according to various embodiments of the present invention is to be:

$$0.369+0.261=0.63\%$$

This indicates the improvement of 0.261%, compared with the optical system efficiency 0.369% of a head lamp to which the shield 40 which integrally forms the reflective surface 42 is not applied.

Meanwhile, the lens transmissivity, the main lens transmissivity, the shield efficiency, and the reflective mirror reflectivity of the existing head lamp and the lens transmissivity, the shield efficiency, the reflective mirror reflectivity, and the shield reflective surface reflectivity of the improving head lamp 1 and the effective solid angle of the light source 60 and the reflective mirror 50 may be readily adjusted. In various embodiments, the optical system efficiency of the improving head lamp 1 is improved compared with the optical system efficiency of the existing head lamp.

Figure 8:
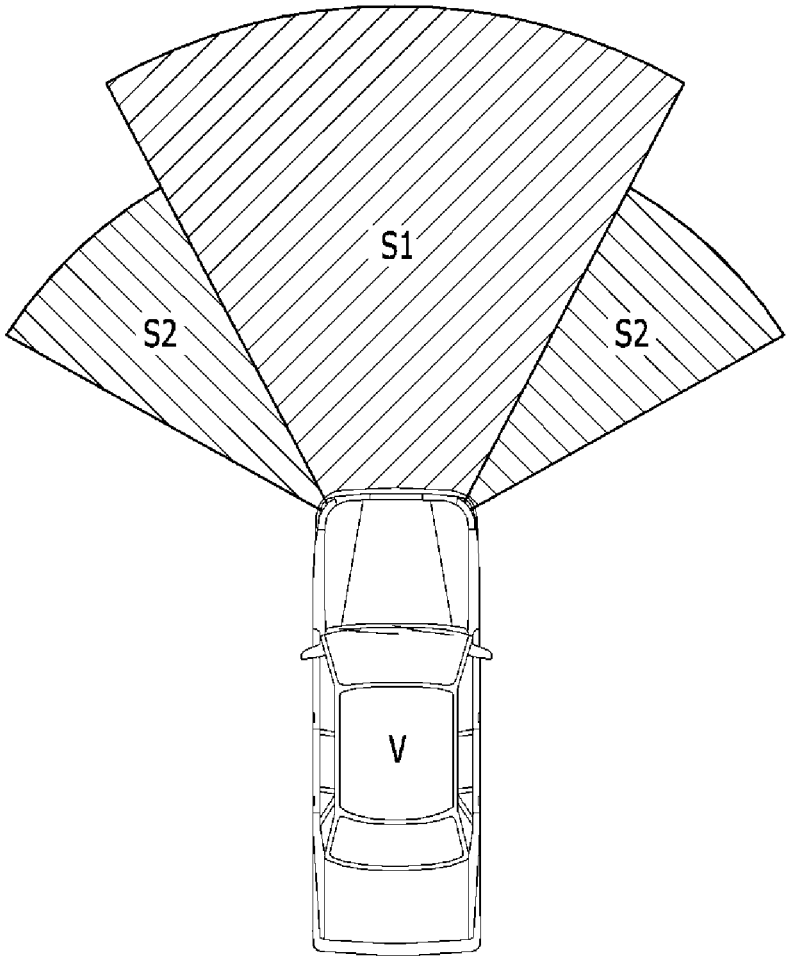
FIG. 8 is a drawing showing a low beam directing area of an exemplary head lamp for a vehicle according to the present invention.

FIG. 8 is a drawing showing a low beam directing area of a head lamp for a vehicle according to various embodiments of the present invention. As shown in FIG. 8, a low beam directing area S1+S2 of the head lamp 1 is larger than a low beam directing area 51 of the existing head lamp.

FIG. 8 schematically shows a low beam directing area of a head lamp 1 for a vehicle according to various embodiments of the present invention. In addition, FIG. 8 visibly shows the low beam directing area S1+S2 of the head lamp 1, the low beam directing area S1 of the existing head lamp, and a low beam directing area S2 of the head lamp 1 which is enlarged compared with the low beam directing area S1 of the existing head lamp in front of a vehicle V.

According to various embodiments of the present invention, utilization efficiency of the light released from the light source 60 can be increased by using the light having shielded by the shield 40. In addition, a production cost is not excessively increased and simultaneously a performance of low beam can be improved as the shield 40 forms the reflective surface 42. Further, driving safety of a vehicle is improved and ensured as a low beam directing area is enlarged.

For convenience in explanation and accurate definition in the appended claims, the terms "upper" or "lower", "front" or "rear", "inside" or "outside", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A head lamp for a vehicle comprising:

a light source emitting a light;

a reflective mirror reflecting the light emitted from the light source;

a shield implementing a low beam by transmitting a first part of the light that is emitted from the light source and/or reflected by the reflective mirror and projected toward a front of the vehicle and shielding a second part of the light that is emitted from the light source and/or reflected by the reflective mirror and projected toward the front of the vehicle;

a main hole formed at the shield to allow the first part of the light to pass through;

a main lens transmitting the first part of the light that has passed through the main hole of the shield toward the front of the vehicle;

a reflective surface reflecting the second part of the light; and a sub lens transmitting the light reflected by the reflective surface, wherein the reflective surface is integrally formed with the shield, and wherein the head lamp further comprises a sub hole, which is formed at the shield, to allow the light reflected by the reflective surface pass through.

2. The head lamp of claim 1, wherein the sub lens transmits the light that has passed through the sub hole of the shield.

3. The head lamp of claim 2, wherein the sub lens transmits the light that has passed through the sub hole of the shield to an area that is not illuminated by the first part of the light that has passed through the main hole of the shield and transmitted by the main lens.

4. The head lamp of claim 3, wherein the light passed through the sub hole of the shield and transmitted by the sub lens enlarges an area of the low beam.

5. The head lamp of claim 1, further comprising:

a holder disposed between the main lens and the shield such that the main lens is disposed apart from the shield by a set distance, wherein the holder connects the main lens with the shield, and comprises a groove formed at the holder for disposing the reflective surface and corresponding to the sub hole.

6. The head lamp of claim 5, wherein the light source is mounted to the reflective mirror and the shield is interposed between the reflective mirror and the holder, the head lamp further comprises:

a bezel formed in a hollow cylinder shape for disposing inside thereof an assembly that includes the reflective mirror, the shield, the holder and the main lens.

7. The head lamp of claim 6, wherein the bezel includes:

a main lens hole for disposing the main lens such that the light that has passed the main lens is directed toward the front of the vehicle, and a sub lens hole for mounting the sub lens such that the light that has passed the sub lens is directed toward the front of the vehicle.

8. The head lamp of claim 1, wherein the light reflected by the reflective surface is directed to implement the low beam.

9. The head lamp of claim 8, wherein the light reflected by the reflective surface is directed to an area that is not illuminated by the light passed through the main hole of the shield and transmitted by the main lens.

10. The head lamp of claim 8, wherein the light reflected by the reflective surface and implementing the low beam improves utilization efficiency of the light emitted from the light source.

* * * * *